US006199862B1

(12) United States Patent
Long et al.

(10) Patent No.: US 6,199,862 B1
(45) Date of Patent: Mar. 13, 2001

(54) TOKEN DROP

(76) Inventors: Shane Long, 58 Depot Rd., Uncasville, CT (US) 06382; David Warren, Rte. 32 and Quaker, Tillson, NY (US) 12486

( * ) Notice: Subject to any disclaimer, the term of this patent is extended or adjusted under 35 U.S.C. 154(b) by 0 days.

(21) Appl. No.: 09/168,684

(22) Filed: Oct. 9, 1998

Related U.S. Application Data

(60) Provisional application No. 60/061,584, filed on Oct. 10, 1997.

(51) Int. Cl.[7] ..... E05G 1/00

(52) U.S. Cl. ..... 273/148 R; 232/4 R; 232/57; 273/309

(58) Field of Search ..... 273/272, 148 R, 273/309; 453/63; D99/34, 35, 36, 37; 446/8, 9, 10, 13; 232/1 D, 4 R, 15, 47, 48, 49, 51, 55, 57, 62, 65; 194/287, 288, 351

(56) References Cited

U.S. PATENT DOCUMENTS 383,579 * 5/1888 Kittell .
1,400,823 * 12/1921 Koenig .
3,292,849 * 12/1966 Ewing .
5,560,512 * 10/1996 Hahn .
5,595,129 * 1/1997 Grobe .

OTHER PUBLICATIONS

Road, Las Vegas Nevada 89102, p. 72, 1997.*

* cited by examiner

*Primary Examiner*—William M. Pierce

(57) ABSTRACT

A device for dropping tokens into a drop box. The device may be used on a gaming table over a drop box. The device has a base, which is mounted on a surface, and a door, which is movably connected to the base. The door swings open to allow tokens, coins, chips, etc., to drop through the base into a drop box below. The door also allows the tokens, coins, chips, etc, to rest so that they may seen before being dropped into the drop box. This device is particularly useful on poker tables, where the casino takes a cut of the winnings.

21 Claims, 11 Drawing Sheets

Base Without Door

DOOR VIEW

TOKEN DROP

CROSS REFERENCE TO RELATED FILINGS

This application claims priority of provisional patent application No. 60/061,584 filed with the U.S. Patent Office on Oct. 10, 1997.

BACKGROUND

Devices for dropping tokens into a drop box on a casino gaming table are inadequate. The devices are awkward, crude, and the devices rapidly and inevitably wear out.

What is needed is a long-lasting device which provides a simple manner of dropping tokens into a drop box.

What is needed is an elegant device that conveniently holds tokens before it drops them into a drop box.

What is needed is a simple device for dropping tokens into a drop box that is easily and inexpensively manufactured.

What is needed is a simple device for dropping tokens into a drop box that is easily and inexpensively installed.

What is needed is a long-lasting device for dropping tokens into a drop box that is easily and inexpensively maintained.

SUMMARY OF THE INVENTION

This invention is a device for dropping tokens into a drop box. Specifically, the present invention is a token drop for use over a drop box on a casino gaming table. The two primary components of this invention are a base, which is mounted to the gaming table, above the drop box, and a door, which is movably connected to the base. The tokens are placed on the door when closed and the door is moved or swung open to allow the tokens to drop into a drop box below. This token drop is particularly useful on poker tables, where the casino takes a percentage or cut of the winnings. The device provides a resting place for the tokens while they are being loaded on the closed door and allows the operator to easily drop the tokens into the drop box, all in clear view of surveillance cameras. The token drops can also be electronically monitored.

It is an object of this invention to create a long-lasting device which provides a simple manner of dropping tokens into a drop box.

It is an object of this invention to create an elegant device that conveniently holds tokens before it drops them into a drop box.

It is an object of this invention to create a simple device for dropping tokens into a drop box that is easily and inexpensively manufactured.

It is an object of this invention to provide a simple device for dropping tokens into a drop box that is easily and inexpensively installed.

It is an object of this invention to provide a long-lasting device for dropping tokens into a drop box that is easily and inexpensively maintained.

DETAILED DESCRIPTION

The invention relates to an apparatus and method for depositing tokens in a receptacle. More particularly, it relates to a token drop for use over a drop box on a gaming table that is not only simple to use, but is also reliable, durable, and easy to manufacture. Generally, the token drop is comprised of two main parts, a base, which is mounted on a gaming table above a drop box and a door, which is connected to the base and has a closed and an at least one open position providing access to the drop box.

Figure 1:
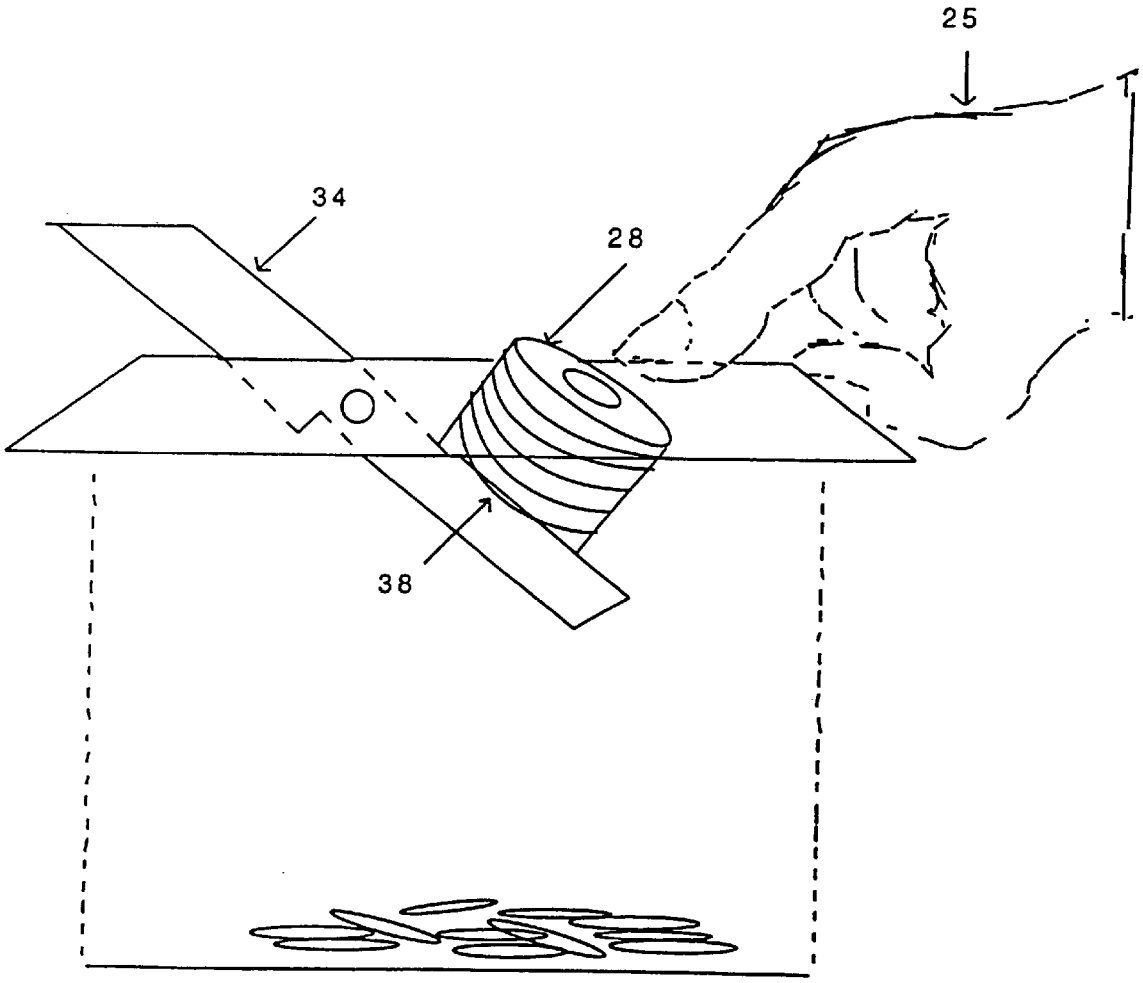
FIG. 1 is a side view of a preferred embodiment of the token drop with the door partially open.

FIG. 1 shows a method for dropping one or more tokens 28 into a drop box 22 on a gaming table (not shown), using a token drop door 34. The method involves placing one or more tokens 28 on the token drop door 34, and pivoting the door 34 to expose an opening 38, whereby the tokens 28 pass through the opening 38 and drop into the drop box 22 below. The door 34 can be moved by the operator 25 either applying a direct force on the door 34 or by a applying a direct force to the tokens 28 on the door 34, as shown in FIG. 1. The door 34 has a closed position and can be moved into an open position by the operator 25. The door can be configured so that once open, it pivots or returns to the closed position. In some embodiments, the door 34 uses the force of gravity to return to its closed position automatically.

Figure 2:
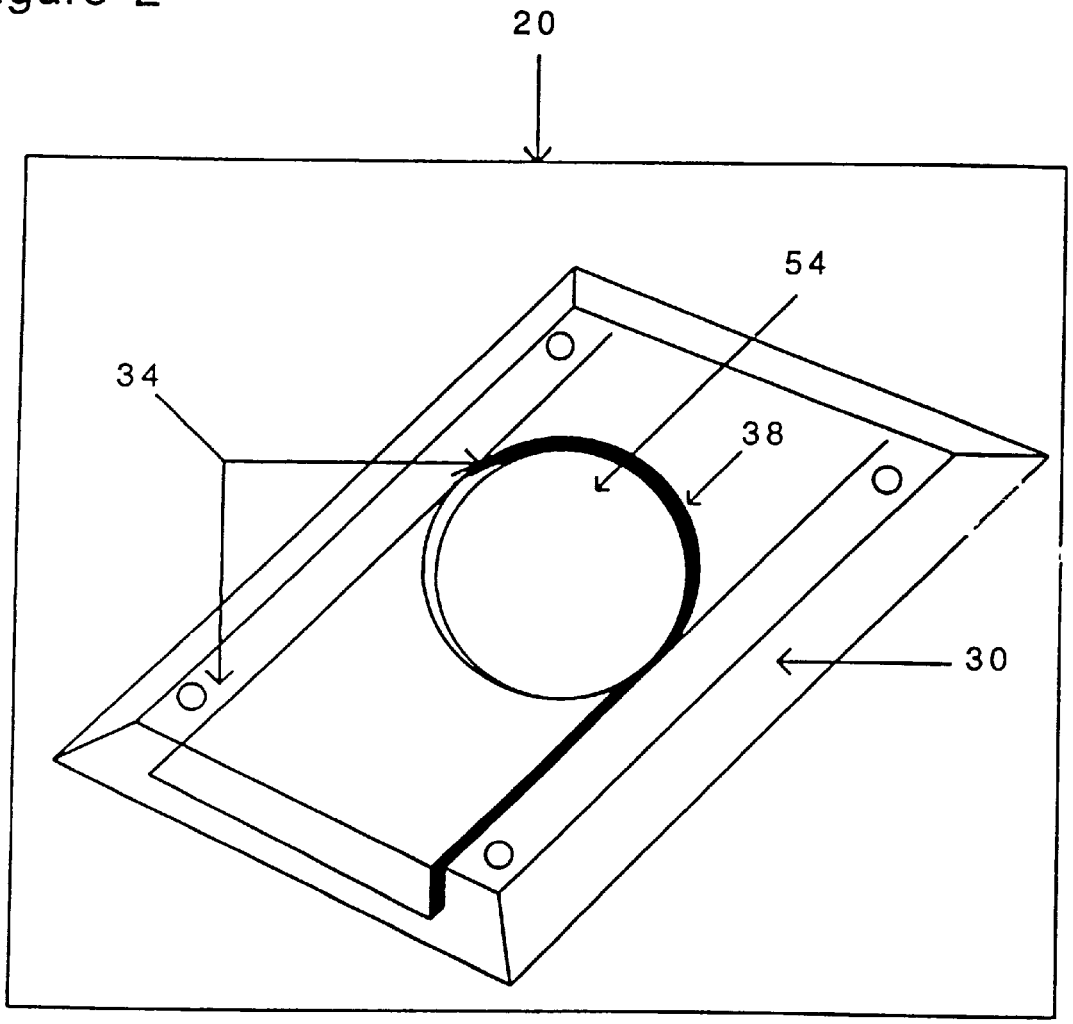
FIG. 2 is a perspective view showing the main components of a preferred embodiment of the token drop.

FIG. 2 shows a preferred embodiment of the token drop 20. FIG. 2 is comprised of two primary elements: a base 30 and a door 34. The base 30 is immovably mounted over the drop box 20 on a gaming table, and has an opening 38 (covered by the door 34). Preferably, the base 30 is mounted to the gaming table using screws or bolts (not shown). The base 30 is preferably made of brass. FIGS. 3 and 4 show the preferred embodiment of the base 30 in greater detail, while FIGS. 6, 9*a,* 10, and 11*a* show alternative embodiments of the base 30.

Referring to FIG. 2, in the preferred embodiment, the door 34 is movably connected to the base 30 and is positioned over the opening 38 of the base 30. The door 34 has a closed position and an at least one open position. In the closed position, the door 34 covers the opening 38. The door 34 is directly moved by the operator 25 (not shown), either through direct force on the door 34 or by a direct force on the tokens 28 on the door 34. The door 34, like the base 30, is preferably made of brass. The door 34 has a lid 54 and other parts. FIG. 5 shows the preferred embodiment of the door 34 in greater detail and with slight variations, while FIGS. 7, 9*b,* 10, and 11*b* show alternative embodiments of the door 34.

Referring to FIG. 2, the door 34 will usually be made of the same material as the base 30 to simplify manufacturing and reduce the time and cost of manufacturing. Although brass is preferred, both the base 30 and the door 34 can be made from a variety of materials including any type of metal, plastic or wood or any combination thereof. The method of manufacturing the token drop 20 involves the steps of making the base 30, with an opening 38, and making the door 34, which covers the opening 38 in the base. These steps are preferably achieved by creating a mold for the base 30 and the door 34, and pouring the chosen material into the mold. Alternatively, the base 30 and the door 34 could be machined from pieces of the chosen material. The base and the door are then assembled or connected.

Figure 3A:
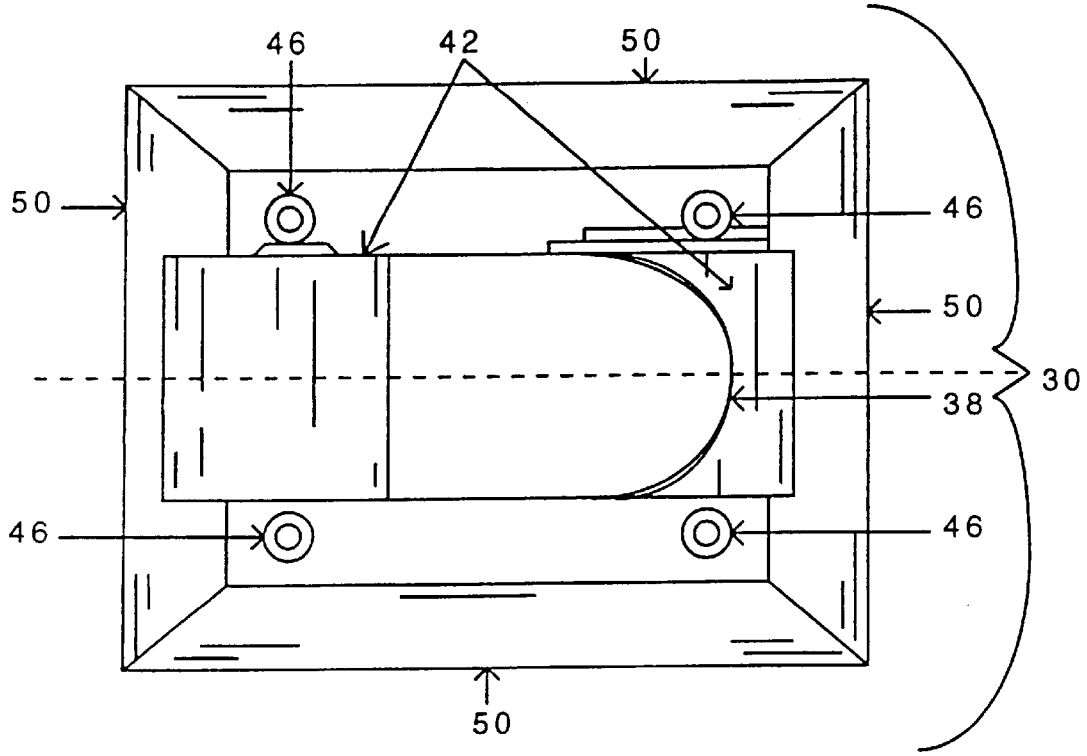
FIG. 3*a* is a top view showing a preferred embodiment of a base of the token drop.
Figure 3B:
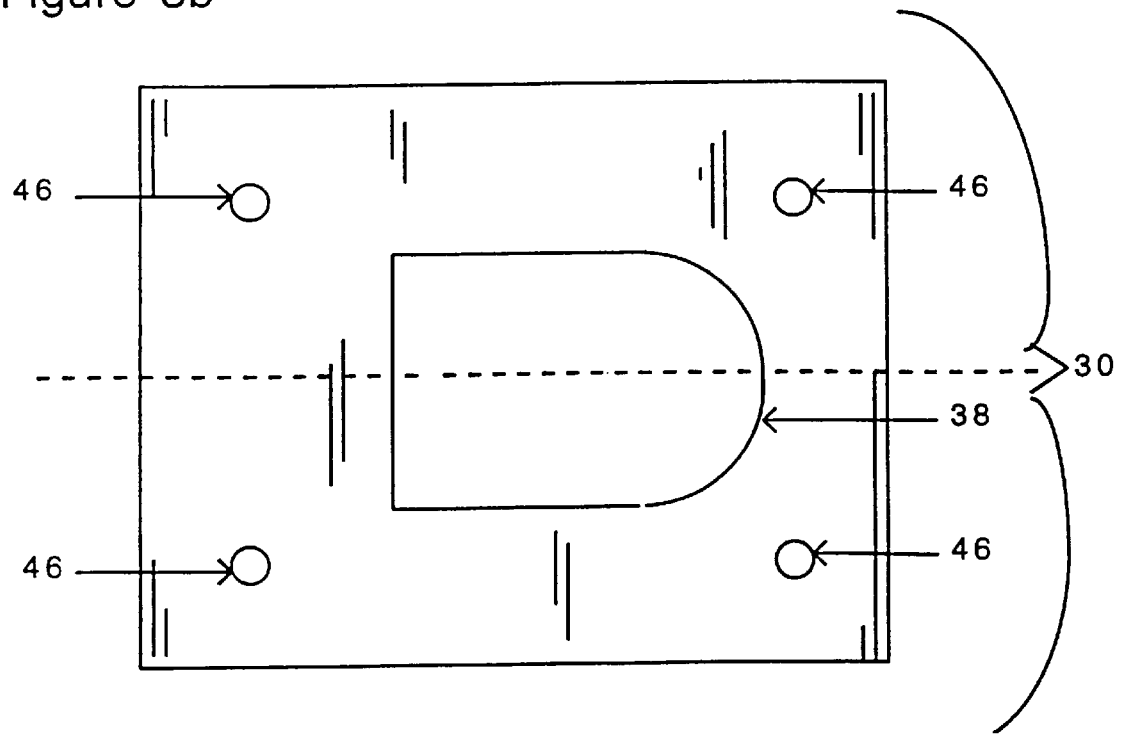
FIG. 3*b* is a bottom view showing a preferred embodiment of a base of the token drop.

FIGS. 3*a* and 3*b* show the preferred embodiment of the base 30 in greater detail. Although the base 30 appears as a rectangle or square in this and the other embodiments depicted, this portrayal is simply illustrative. Other shapes for the base, such as an oval, will function as well. The base 30 can also be made in various sizes. In a preferred embodiment the base 30 has a length of approximately 82 mm, a width of approximately 94 mm, and a height of approximately 10 mm. This size will accommodate a token usually about 1–2 inches in diameter. The diameter or width of the opening should be slightly larger than a token. The base is preferably of sufficient thickness to be sturdy and durable.

FIG. 3*a* shows a base 30 with more than just an opening 38; it also has a depressed area 42, four counter-bored holes 46, and four sloping edges 50. As seen in FIG. 3*a,* the depressed area 42 is centered about a central axis of the base 30 (central axis shown in dotted lines), and is of rectangular shape. It is within the depressed area 42 that the door 34 will be situated or rest when in the closed position.

The opening 38, as shown in FIG. 3*a,* is situated within the depressed area 42. The opening 38 is shaped like an elliptic arch, the intrados (or top) of the arch approximating an ellipse and the "bottom" of the arch being a straight line, as shown in FIGS. 3*a* and 3*b.* The opening 38 provides access to the drop box.

The four counter-bored holes 46, as shown in FIGS. 3*a* and 3*b,* are located in four comers of the base 30. The holes 46 extend completely through the base 30. Four screws (or bolts) are placed through the holes 46 and tightened into corresponding holes in the gaming table (not shown) to fix the token drop 20 to the table.

The four sloping edges 50, as shown in FIG. 3*a,* slope upward and inward at approximately forty-five degrees. The sloping edges 50 allow the operator easier access to slide the chips on the door by providing a smooth, continuous approach to the door 34, where the tokens 28 are placed. The bottom of the depressed area 42 cuts through two of the sloping edges 50, as shown in FIG. 3*a.*

Figure 4A:
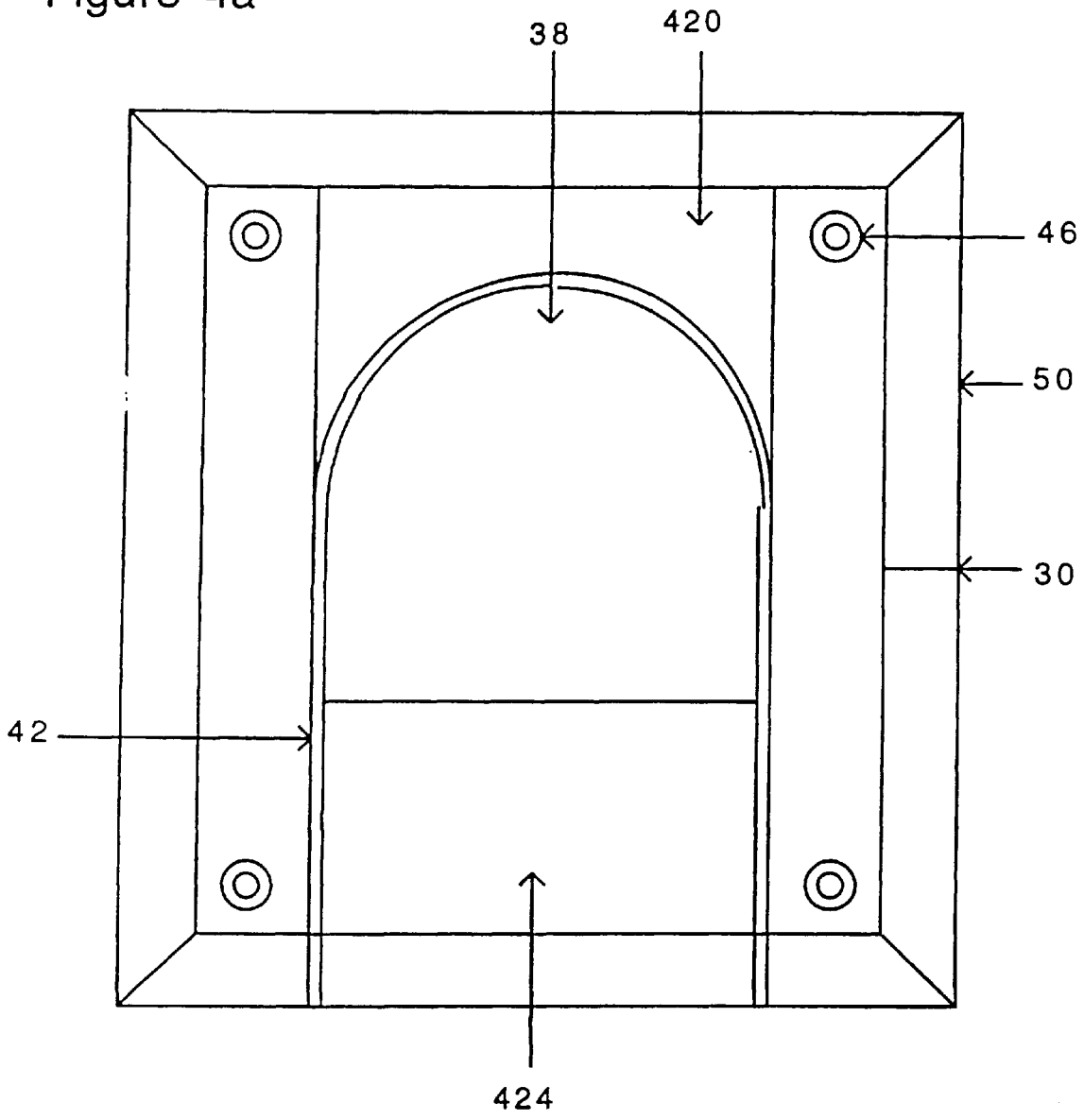
FIG. 4*a* is a top view showing in greater detail a preferred embodiment of a base of the token drop.
Figure 4B:
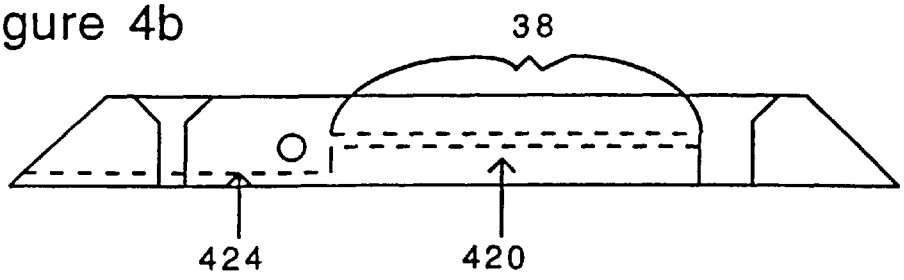
FIG. 4*b* is a side view showing a preferred embodiment of a base of the token drop with the door closed.

FIGS. 4*a* and 4*b* show the preferred embodiment of the token drop 20 in even greater detail. In these figures, the depressed area 42 of the base 30 is further divided into a front section 420 and a rear section 424. The rear section 424 is of greater depth than the front section 420. The opening 38 is situated so that a greater portion of it lies within the front section 420 of the depressed area 42 than the rear section 424 of the depressed area 42. This better accommodates a swinging door 34 configuration.

FIG. 4*b* is a side view of the base 30, and shows the relation between the front section 420, the rear section 424, and the opening 38. As shown in FIG. 4*b,* the rear section 424 of the depressed area 42 is approximately twice as deep as the front section 420. This best accommodates the preferred embodiment of the door 34, which is described below with FIGS. 5*a,* 5*b* and 5*c.*

Figure 5A:
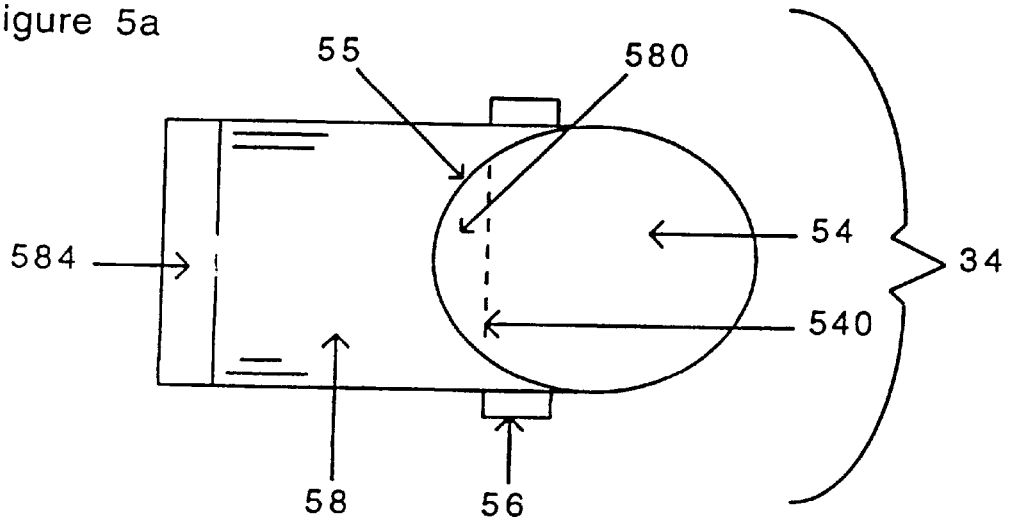
FIG. 5*a* is a top view showing a preferred embodiment of the door of the token drop.
Figure 5B:
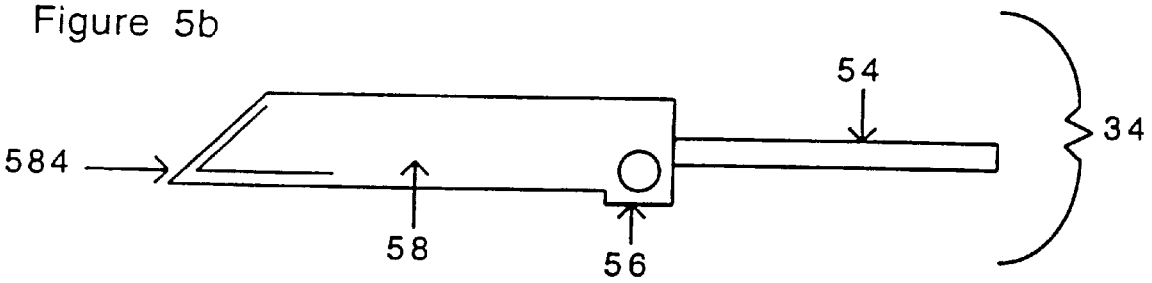
FIG. 5*b* is a side view showing a preferred embodiment of the door of the token drop.
Figure 5C:
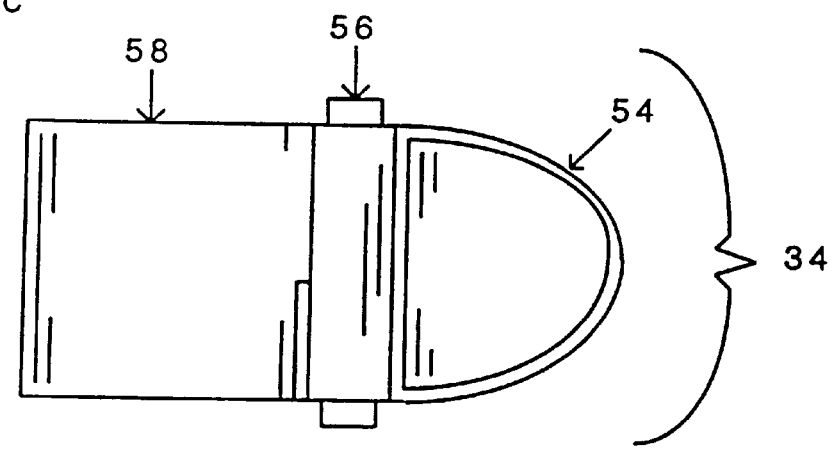
FIG. 5*c* is a bottom view showing a preferred embodiment of the door of the token drop.

FIGS. 5*a,* 5*b,* and 5*c* show the preferred embodiment of the door 34 in greater detail. The door 34 is shown with a lid 54, a weighted portion 58, and a connecting means 56. As best shown in FIGS. 5*a* and 5*c,* the lid 54 is an elliptic shape with a squared off end 540. The boundary between the lid 54 and the weighted portion 58 is illustrated by the dotted line representing the squared off end of 540 of the weighted portion 58. The lid 54 covers the elliptic arch shaped opening 38 when the door 34 is in the closed position. The top of lid 54 also provides a resting place for the tokens 28 until they are dropped into the drop box 22. When the lid 54 is pushed downward through the opening 38, the door 34 is in the open position, as shown in FIG. 1.

The weighted portion 58 is rectangularly shaped. The weighted portion 58 is connected to the lid 54 at its squared off end 540. The weighted portion generally rests within the rear section 424 of the depressed area 42 of the base 30 when the door 34 is in the closed portion. When the door 34 is moved to an open position, the weighted portion 58 rises above the base 30, as illustrated in FIG. 1. When the door 34 is made of one material, the weighted portion 58 is preferably about three times as thick as the lid 54, as shown in FIG. 5*b.* This allows the top of weighted portion 58 to sit or rest flush with the top of the base 30 when the door 34 is in the closed position. This provides the operator with easier access to the lid 54 as it forms a continuous and smooth surface from the base 30, across the weighted portion 58 and to the lid 54.

In order for the door 34 to return to the closed position, a force equal to or greater than the force applied to open the door 34 must be provided, by a weight, a spring, or other means. The weight of the weighted portion 58, is determined by its thickness and material (preferably brass), and gravity can provide sufficient force to cause the door 34 to return to its closed position. Preferably the weight portion is about three times heavier than the lid 54.

Referring to FIG. 5*b,* the top of the weighted portion 58 is usually higher than the top of the lid 54. Where the weighted portion 58 meets the lid 54, the weighted portion 58 has a rounded area 580 of reduced thickness as best seen in FIG. 5*a.* The rounded area 580 is not considered part of the lid 54; it is considered part of the weighted portion 58 because it is on the same side of the connecting means 56 as the weighted portion 58. The thickness of the rounded area 580 is the same as the lid 54. Therefore, the connection between the lid 54 and the weighted portion 58 is smooth. Where the rounded area 580 of reduced thickness meets the remainder of the weighted portion 58, there is an edge or token catch 55 that prevents the tokens from moving when stacked upon the lid 54. The token edge or token catch is preferably the height of one to three tokens.

The weighted portion 58 also has a sloped area 584 at the end opposite the lid 54, as is shown in FIG. 5*a*. The sloped area 584 provides smoother hand access to the lid 54 where the tokens are stacked. When the door 34 is in its closed position, this sloped area 584 is flush with the sloped edge of the base. This further enhances the continuous surface formed between the base and the weighted portion and its benefits, as discussed above.

The connecting means 56 is attached to the bottom of the lid 54, where the lid 54 connects with the weighted portion 58, as is shown in FIGS. 5*b* and 5*c*. The connecting means 56 connects the lid 54 and/or weighted portion 58 to the base 30. The connecting means 56 can take a variety of forms, such as a hinge, rod and socket, ball and socket, or various spring configurations. In general, the connecting means 56 allows the door 34 to move or swing from one position to another, such as from the open position to the closed. Some examples of various connecting means 56 are described in the below embodiments.

Figure 6:
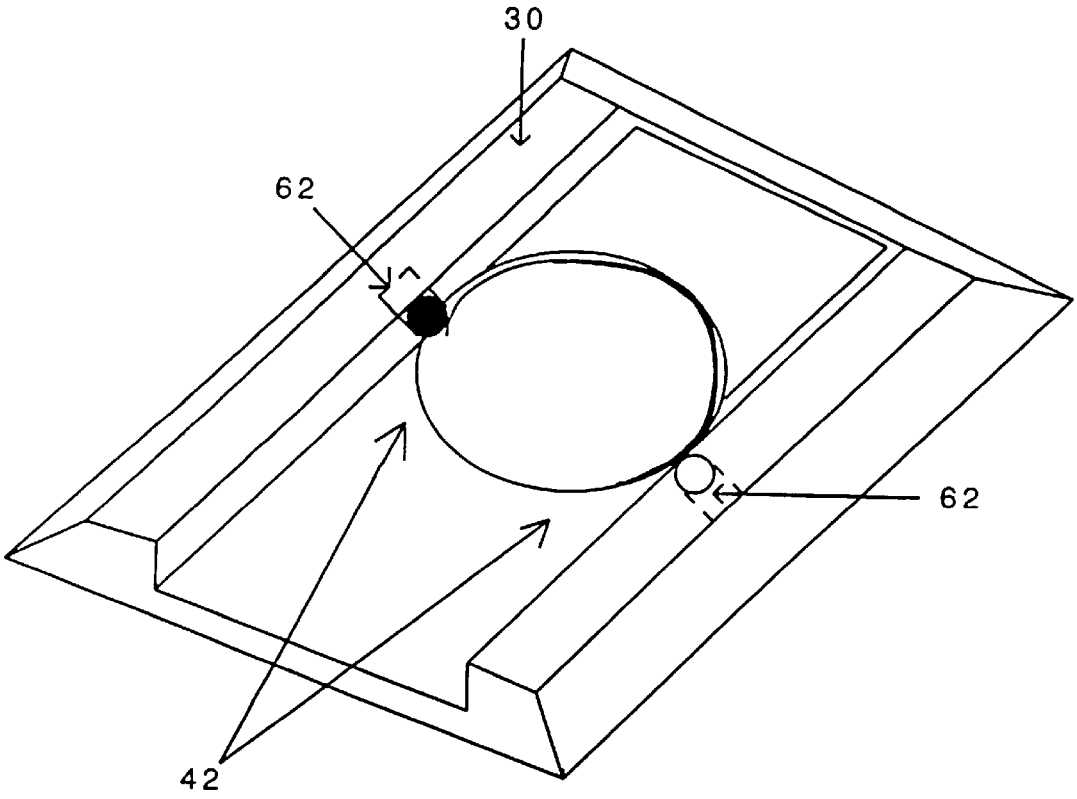
FIG. 6 is a perspective view showing an alternative embodiment of the base with pin holes.

FIG. 6 shows an alternative embodiment wherein the base 30 has at least two pinholes 62. The pinholes 62 are located in opposing vertical walls of the depressed area 42, generally at the horizontal center of the depressed area 42. These pinholes 62 are each capable of holding one pin, rod, or ball, so as to connect the door 34 to the base 30.

FIGS. 7*a*, 7*b*, 7*c* and 7*d* show an alternative embodiment of the door 34 that can be used in conjunction with the base 30 in FIG. 6 or other types of bases. The connecting means 56 is shown as a pair of spring loaded pins 66 one or more springs 68, and a cylindrical hole 70. The spring-loaded pins 66 are situated in the cylindrical hole 70, which runs through the width of the lid 54 along the center axis of the door 34 where the lid 54 and the weighted portion 58 meet. One of the spring loaded pins 66 is at one end of the cylindrical hole 70, and the other spring loaded pin 66 is at the other end of the cylindrical hole 70. The door 34 is rotatably connected to the base by squeezing these protruding ends 660 of the pins 66 towards the door 34, lowering the door 34 into the base, and releasing the protruding ends 660 of the pins 66 into the pinholes of the base. When the pins 66 are squeezed the spring 66 is compressed. In this embodiment, there is one spring 68 for both pins 66. In another alternative embodiment, there could be two springs 68, one for each of the pins 66.

Figure 7A:
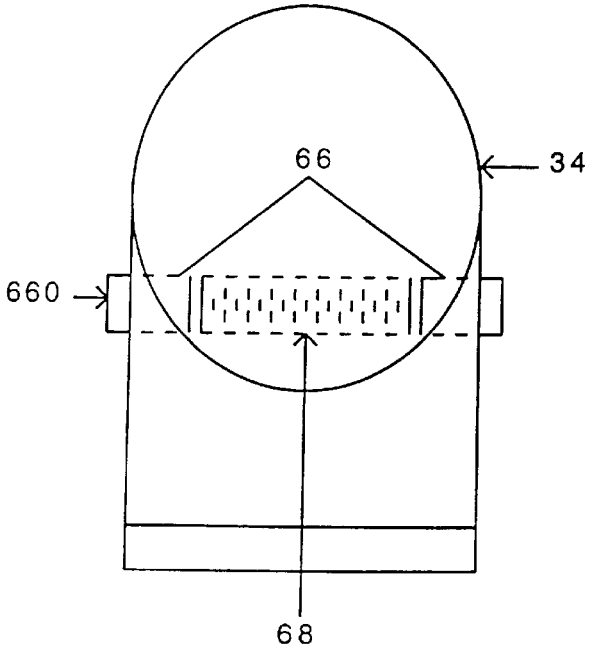
FIG. 7*a* is a top view showing an alternative embodiment of the door with a cutaway view of a pair of springloaded pins.
Figure 7B:
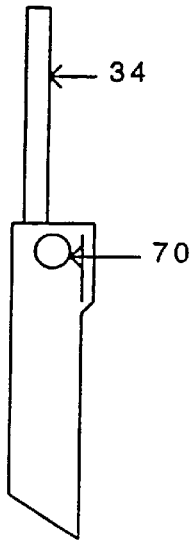
FIG. 7*b* is a side view showing an alternative embodiment of the door with a cylindrical hole.
Figure 7C:
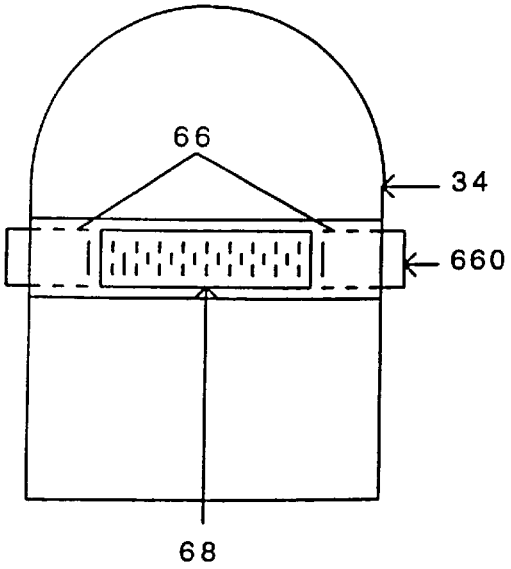
FIG. 7*c* is a bottom view showing an alternative embodiment of the door with a cutaway view of a pair of spring-loaded pins.
Figure 7D:
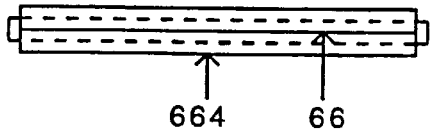
FIG. 7*d* is a top view showing a sleeve around a pair of spring-loaded pins.

FIG. 7*d* shows the pins 66 with a sleeve 664 placed around them. The sleeve 664 would protect the base 30 and the door 34 from being worn down by the metal of the pins 66. The sleeve 664 is preferably fabricated with a metal softer than the metal of the base 30 and the door 34. The door 34 will pivot on the sleeve 664 or the sleeve 664 will rotate in the pinholes 62 of the base 30, e.g., the sleeve 664 may be stationery or moving. Since the sleeve 664 is a softer material it will wear rather than the pinhole 62.

Figure 8A:
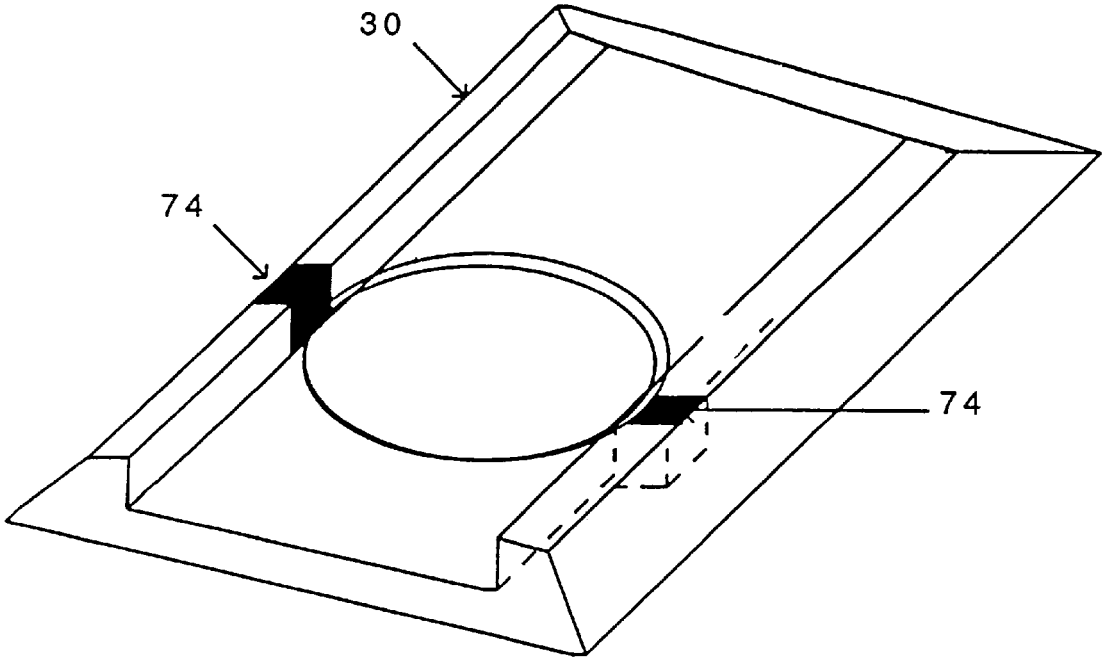
FIG. 8*a* is a perspective view showing an alternative embodiment of the base with vertical slots.
Figure 8B:
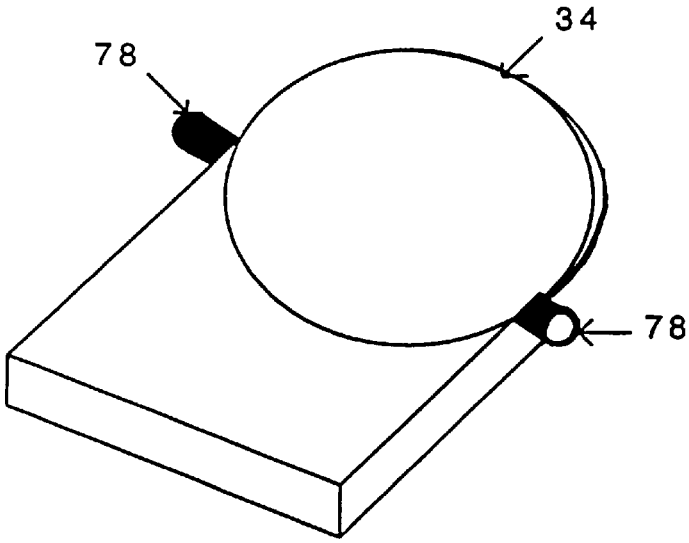
FIG. 8*b* is a perspective view showing an alternative embodiment of the door with cylindrical protrusions.

FIGS. 8*a* and 8*b* show another embodiment of the token drop 20. In this embodiment, the base 30 has a pair of slots 74 and the connecting means 56 is a pair of cylindrical protrusions 78. The door 34 is connected to the base 30 with the cylindrical protrusions 78 by lowering the cylindrical protrusions 78 into the slots 74. The cylindrical protrusions 78 are situated in the slots 74, and the door 34 is thereby rotatably connected to the base 30. In an alternative of this embodiment, the slots could be covered over with a metal cover or bridge, further securing the door 34 in the base 30.

There are numerous ways to connect the door to the base. In another variation, the connecting means 56 is not part of the door 34, but rather, are part of the base 30. An example of this would be where the base 30 had spring-loaded pins 66 in the vertical walls of its depressed area 42. The door 34 in this example would have pinholes 62 on opposite sides, and the protruding ends 660 of the pins 66 of the base 30 would be released in to the pinholes 62 of the door 34.

Figure 9A:
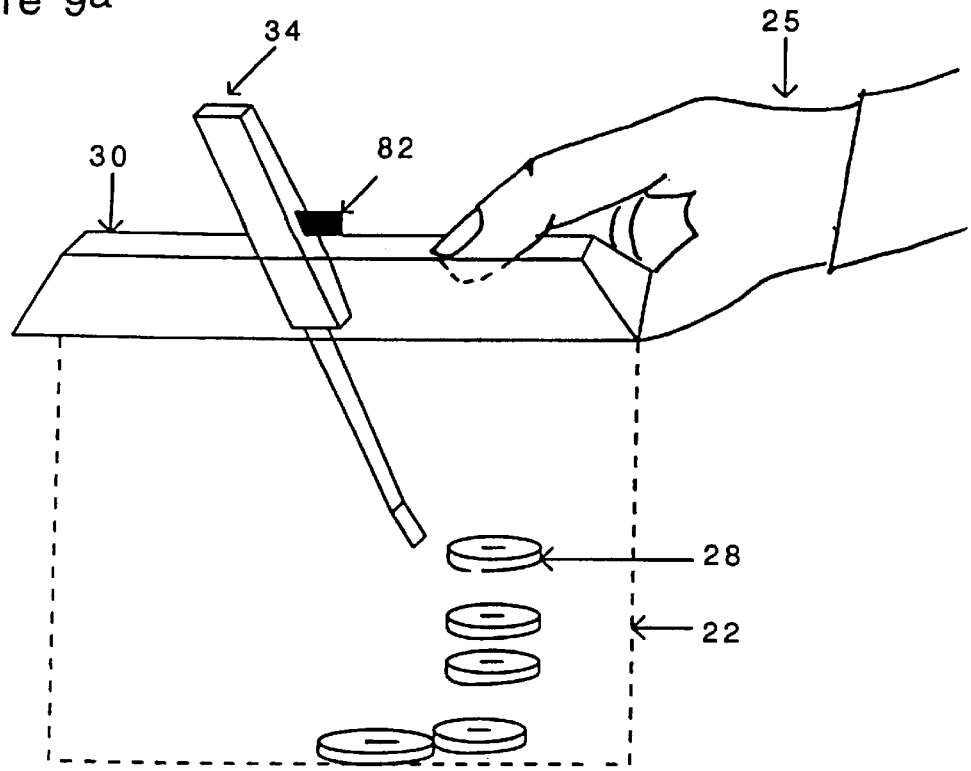
FIG. 9*a* is a side view showing an alternative embodiment of a token drop with stops on the base.
Figure 9B:
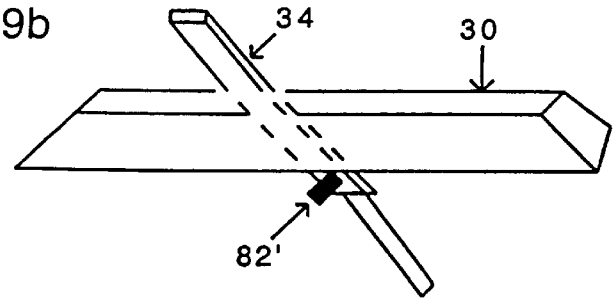
FIGS. 9*b* and 9*c* are a side view showing an alternative embodiment of a token drop with stops on the door.
Figure 9C:
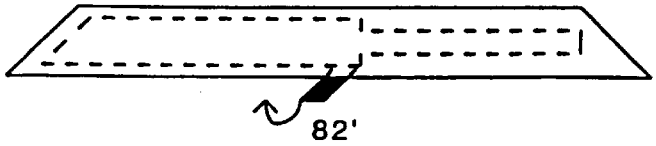

FIGS. 9*a* and 9*b* show another embodiment of the token drop 20. This embodiment has the additional element of either a stop 82 (shown in FIG. 9*a*) on the base 30 or a stop 82' on the door 34 (shown in FIG. 9*b*). The purpose of the stops 82 is to prevent the door 34 from over-rotating into the opening 38. If this were to happen, the door 34 may stick in its open position. Any of a number of methods to stop the door may be used. For example, a stop 82" (not shown) can be built onto the connecting means 56.

Figure 10:
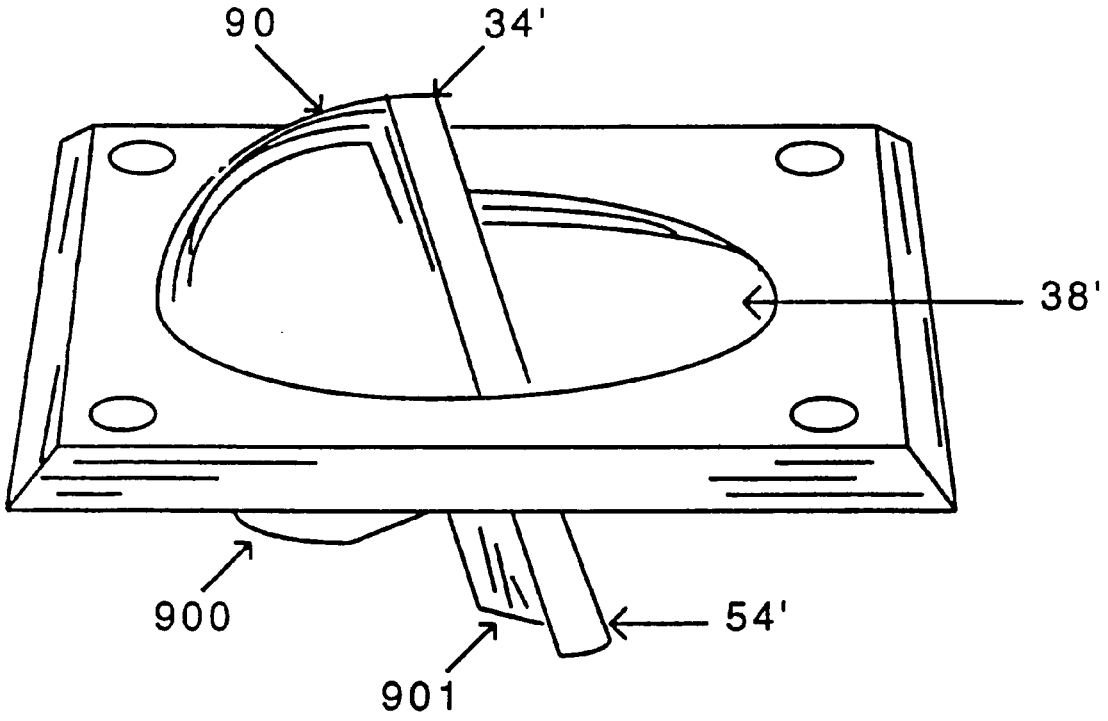
FIG. 10 is a perspective view showing an alternative embodiment of a token drop with a weighted keel.

FIG. 10 shows another embodiment of the token drop 20. Here, the base 30' is a squarely shaped and has a circular opening 38'. The door 34' has a lid 54' and a weighted keel 90. The lid 54' is circular and is situated within the circular opening 38' of the base 30'. The weighted keel 90 is connected the bottom of the lid 54', and has a rear portion 900 and a front portion 901. The rear portion 900 is thicker, and thereby, heavier than the front portion 901. The weighted keel 90 thereby causes the door 34' to use the force of gravity to return to its closed position from its open position. The weighted keel may have a narrow cross-section or it may be shaped like the back half of a bathtub or ship.

Figure 11A:
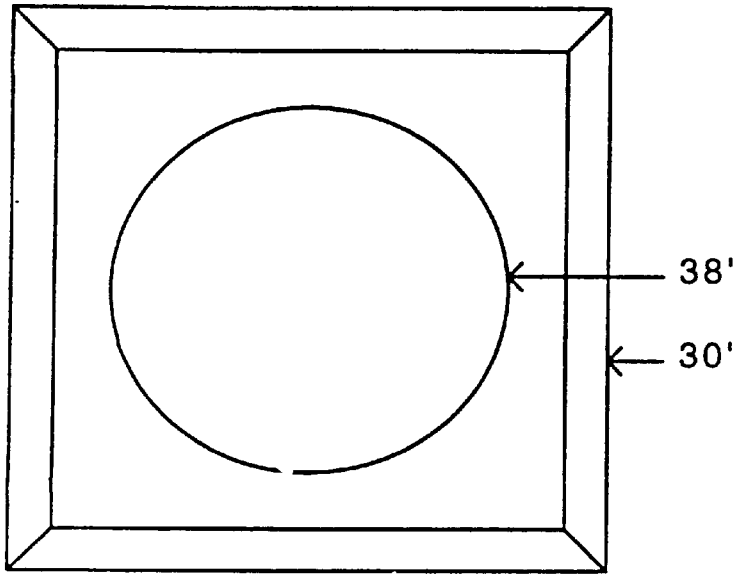
FIG. 11*a* is a top view of an alternative embodiment of a token drop with a square base and a circular opening.
Figure 11B:
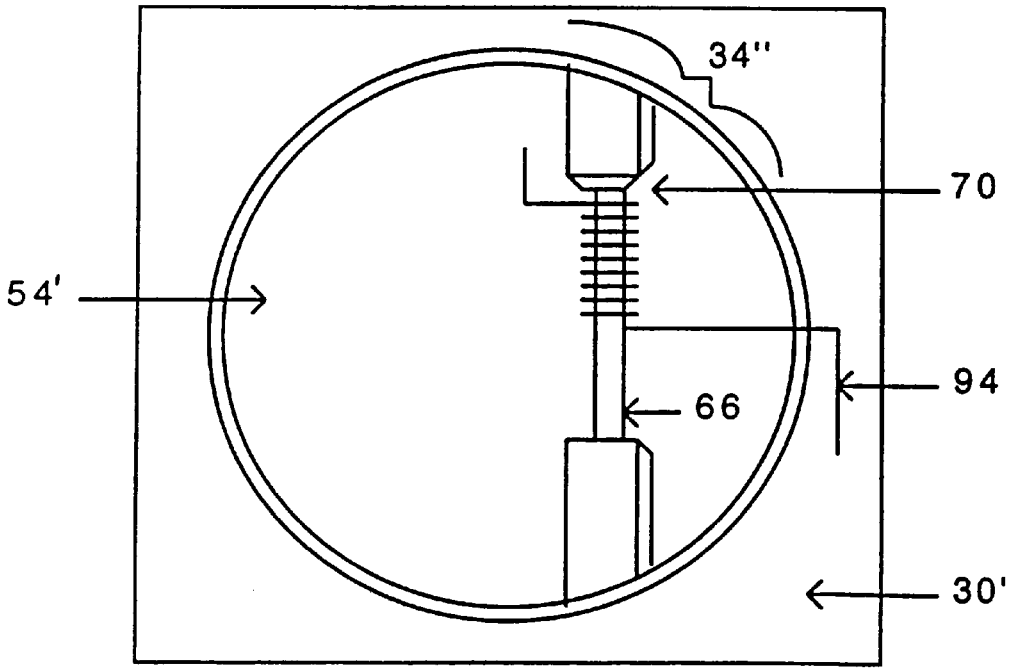
FIG. 11*b* is a bottom view of an alternative embodiment of a token drop with a spring

FIGS. 11*a* and 11*b* show another embodiment of the token drop 20. Here the base 30' also is squarely shaped and has a circular opening 38'. The door 34" has a lid element 54' and a spring 94 element. The lid 54' is circular and is situated within the circular opening 38' of the base 30'. The lid 54' has a cylindrical hole 70 through it with a pin 66 positioned within the cylindrical hole 70 and connecting the lid to the base 30'. The spring 94 is connected to the pin 66 and the base 30 (see FIG. 11*b*) whereby it allows the operator 25 to directly move the door to the open position and forces the door 34" to return to its closed position otherwise.

In another embodiment, not shown in any figure, the connecting means 56 is similar to a hinge, such as a hinge used for the door to a house. The hinge would include a rod and two supports. One support connected to the base, and the other connected to the lid. The rod would run through the center of the supports. When the door moved, one support would rotate around the rod while the other remained stationary.

Not shown in any figure is an embodiment of the token drop including an electronic monitoring advice. This device would monitor the presence of tokens on the token drop, when the token drop was used, how many tokens dropped, and the like. One example of this embodiment would be if there were an electrical contact on the base 30 and an electrical contact on the door 34. These contacts would form an electrical connection when they met, thereby completing a circuit and sending a signal to a monitoring means. These contacts would meet whenever the door 34 was opened or closed.

The terms and descriptions used herein are set forth by way of illustration only and are not meant as limitations.

Those skilled in the art will recognize that numerous variations are possible within the spirit and scope of the invention as defined in the following claims.

What is claimed is:

1. A token drop for use over a drop box on a gaming table, comprising:

an immovable base having a depressed area that has a rear and front section of different depths and capable of being mounted on a gaming table and over a drop box, with an opening, a door, flush with the base and movably connected to the base and positioned over the opening, having a closed position and at least one open position, wherein the door may be directly moved by an operator.

2. A token drop, for use over a drop box on a gaming table, comprising:

a base, mounted over the drop box, comprising:

a depressed area, of rectangular shape, centered about a central axis of the base, with a rear and front section, the rear section being of greater depth than the front section;

an opening, shaped like an elliptic arch with a flat bottom, situated within the depressed area, so that a greater portion of it lies within the front section of the depressed area than the rear section, whereby the opening provides access to the drop box; and at least two pinholes, located in opposing vertical walls of the depressed area, at the center of the depressed area, positioned over the opening, whereby the pinholes could each hold one pins and a door, rotatably connected to the base, with a closed and an open position, comprising:

a lid, of elliptic shape with one end squared off, that covers the opening in the base when the door is in the closed position, a weighted portion, rectangularly shaped, connected with the lid at its squared off end, that is situated within the rear section of the depressed area when the door is in the closed position, and is three times the thickness of the lid, whereby it is flush with the top of the base when so situated, except for a rounded area of reduced thickness situated at the connection with the lid;

a cylindrical hole, running through the width of the lid along the center axis of the door where the weighted portion and the lid; and at least two spring-loaded pins, situated within the cylindrical hole, such that one end of each pin protrudes from opposite ends of the cylindrical hole and rotatably connects the door to the base by protruding into the two pinholes in opposing vertical walls of the depressed area.

3. A token drop as in claim 1, wherein the base has at least one counter-bored hole whereby the base may be mounted on the gaming table with at least one screw positioned through the counter-bored hole.

4. A token drop as in claim 1, wherein the base has at least one sloped edge that allow easier hand access.

5. A token drop as in claim 1, wherein the door has at least one sloped edge allows easier hand access.

6. A token drop as in claim 1, wherein the opening is shaped like an elliptic arch and the door is comprised of a lid, which is of elliptic shape, that covers the opening.

7. A token drop as in claim 1, wherein the door returns to the closed position automatically using the force of gravity.

8. A token drop as in claim 1, wherein the door pivots.

9. A token drop as in claim 1, wherein the door rotates.

10. A token drop as in claim 9, wherein the door has a stop on it that prevents it from over-rotating.

11. A token drop as in claim 1, wherein the opening is circular and the door is comprised of a lid, which is movably connected to the base with at least one spring that forces the door to return to the closed position from the open position.

12. A token drop as in claim 1, wherein the door comprises a lid and a weighted portion, of rectangular shape, connected to the lid.

13. A token drop as in claim 12, wherein the weighted portion is approximately three times the thickness of the lid.

14. A token drop as in claim 13, wherein the weighted portion has a rounded area of reduced thickness, and the lid is smoothly connected to the weighted portion at said rounded area.

15. A token drop as in claim 1, wherein the door comprises a lid, which covers the opening in the base, and a connecting means, which is situated with the lid.

16. A token drop as in claim 15, wherein the base has a depressed area, which has a pair of pinholes in its opposing vertical walls and the connecting means of the door are a cylindrical hole across the width of the lid that is aligned with the pinholes and a pair of spring-loaded pins wherein each pin is positioned within the cylindrical hole with one end protruding from the hole, and these protruding ends are positioned within the opposing pinholes, thereby rotatably connecting the door to the base.

17. A token drop as in claim 16, wherein a sleeve is placed around the spring-loaded pins to reduce friction and wear.

18. A token drop as in claim 15, wherein the base has a depressed area, which has a vertical slot on each side of the depressed area, and the connecting means of the door are a pair of cylindrical protrusions that are positioned within the slots, thereby rotatably connecting the door to the base.

19. A token drop as in claim 8, wherein the door pivots to the closed position automatically.

20. A token drop as in claim 9, wherein the base has a stop on it that prevents the door from over rotating.

21. A token drop as in claim 1, wherein the door may be indirectly moved by the operator.

* * * * *